US006059905A

United States Patent [19]

Friedman et al.

[11] Patent Number: 6,059,905

[45] Date of Patent: May 9, 2000

[54] PROCESS FOR TREATING A COPPER-BERYLLIUM ALLOY

[75] Inventors: Sam Friedman, Reading; Sherwood Goldstein, Sinking Spring; Yoshio Ito, Wyomissing, all of Pa.

[73] Assignee: NGK Metals Corporation, Reading, Pa.

[21] Appl. No.: 08/412,834

[22] Filed: Mar. 29, 1995

Related U.S. Application Data

[63] Continuation of application No. 08/193,830, Feb. 9, 1994, abandoned, and a continuation-in-part of application No. 08/112,500, Aug. 26, 1993, abandoned.

[51] Int. Cl.[7] ..... C22F 1/08

[52] U.S. Cl. ..... 148/685; 148/686; 148/554

[58] Field of Search ..... 148/685, 686, 148/554

[56] References Cited

U.S. PATENT DOCUMENTS

| | | | |
|---|---|---|---|
| 2,289,593 | 7/1942 | Sawyer et al. | 148/685 |
| 4,179,314 | 12/1979 | Wikle | 148/685 |
| 4,425,168 | 1/1984 | Goldstein et al. | 148/554 |
| 4,551,187 | 11/1985 | Church et al. | 148/411 |
| 4,565,586 | 1/1986 | Church et al. | 148/685 |
| 4,599,120 | 7/1986 | Church et al. | 148/685 |
| 4,657,601 | 4/1987 | Guha | 148/685 |
| 4,692,192 | 9/1987 | Ikushima et al. | 148/685 |
| 4,724,013 | 2/1988 | Church et al. | 148/685 |

FOREIGN PATENT DOCUMENTS 56-163248 12/1981 Japan .

OTHER PUBLICATIONS

A. Guha, High Performance Mill Hardened Beryllium Copper C17510 Strip For Electrical And Electronic Applications, *16th Annual Connectors And Interconnection Technology Symposium* (Nov. 14, 1983) pp. 132–140.

A. Guha et al., *Development Of A Nickel–Containing Beryllium Copper Alloy For Connector Applications* (prior to 1983) pp. 134–140.

M.G. Kinnavy, Recent Developments In Tension Leveling, Iron And Steel Engineeer Yearbook (1972), presented before the AISE Annual Convention (Sep. 28, 1971) (all pages).

S. Goldstein et al., Copper–Beryllium Alloy Strip With Improved Formability, *16th Annual Connectors And Interconnection Technology Symposium,* Nov. 14, 1983 (pp. 1–9).

*Primary Examiner*—Sikyin Ip

*Attorney, Agent, or Firm*—Akin, Gump, Strauss, Hauer & Feld, L.L.P.

[57] ABSTRACT

A treatment process is provided for a copper-beryllium alloy comprising from about 0.2% to about 0.7% beryllium, no greater than 3.5% of cobalt and/or nickel, no greater than 0.5% of titanium and/or zirconium and at least 90% copper, wherein the alloy has been cold worked to a ready-to-finish gauge, comprising the steps of annealing the cold worked ready-to-finish gauge copper-beryllium alloy at a temperature from about 1500° F. to about 1685° F., cold working the annealed copper-beryllium alloy to reduce its gauge to a range of from about 20% to about 60%, and age hardening the copper-beryllium alloy at a temperature of from about 700° F. to about 950° F. for about 1 to about 7 hours. The alloy is characterized by satisfactory levels of strength and electrical conductivity as well as enhanced levels of formability, particularly in the direction parallel to the direction of rolling the alloy.

9 Claims, 4 Drawing Sheets

PROCESS FOR TREATING A COPPER-BERYLLIUM ALLOY

This is a continuation of application Ser. No. 08/193,830, filed Feb. 9, 1994, now abandoned. And a continuation-in-part of application Ser. No. 08/112,500, filed Aug. 26, 1993, now abandoned.

FIELD OF THE INVENTION

The present invention relates to a process for treating a copper-beryllium alloy which provides improved formability with little, if any, sacrifice to strength, conductivity and stress-relaxation.

BACKGROUND OF THE INVENTION

For decades, there have been modifications of the proportions of alloying elements in the copper-beryllium-nickel and/or cobalt systems and changes in thermomechanical processing in attempts to impart an especially desirable combination of engineering characteristics, heretofore unavailable, with varying degrees of success.

U.S. Pat. No. 2,289,593 teaches a ternary age hardenable copper-based alloy containing various proportions of beryllium and nickel (up to 4.25% nickel and 0.8% beryllium) that is characterized by improved conductivity which can be especially utilized in welding electrodes.

U.S. Pat. No. 4,179,314 relates to an age hardenable copper-based alloy containing beryllium, cobalt and/or nickel and minor amounts of other elements (up to 3.5% nickel and 0.2 to 1.0% beryllium) that undergoes thermomechanical treatment to enhance conductivity and mechanical properties at elevated temperatures, especially intended for rotor wedges for electrical generators.

U.S. Pat. No. 4,657,601 teaches a thermomechanical process for making an age hardenable copper-based alloy containing beryllium, cobalt and/or nickel and minor amounts of other elements (0.2 to 0.7% beryllium and 1.0 to 3.5% nickel and cobalt) which produces an improved combination of strength, ductility, formability and conductivity for alloys in strip form intended for the production of spring connectors, among other uses.

An important consideration in the manufacture of strip which is intended for use in various connector applications is the capacity of the material to be formed or bent into useful shapes without cracking. The degree of formability of the material, i.e., the ability of the material to be bent and shaped without fracture, is assessed by dividing the minimum bend radius having no cracking when the material is bent 90° or 180° ("R") by the thickness of the material ("T"). This is known as the R/T ratio. The axis of the bend in the material is made either parallel to or perpendicular to the rolling direction of the strip.

Copper-based alloys such as phosphorus-bronze that derive their strength principally from cold working, that is, deformation below the annealing temperature to cause permanent strain hardening, typically exhibit disparate R/T ratios depending upon the particular bend orientation and strength level of the alloy. Mill hardened copper-beryllium alloys at higher strength levels (greater than 100 ksi TS) are characterized by more nearly isotropic formability than the cold worked alloys as described in *Getting Full Value From Beryllium Copper in Connector Design* (1982), published in the *Proceedings of the 15th Annual Connectors and Interconnection Technology Symposium* (1982).

A family of lower cost, high conductivity copper beryllium connector alloys does exist in which the formability in one direction is significantly different in a transverse direction. U.S. Pat. No. 4,551,187 reports parallel axis to perpendicular axis bend 90° R/T ratios from 3:1 to 9:1. U.S. Pat. No. 4,657,601 cites parallel axis bend to perpendicular axis bend 90° R/T ratios between 2:1 and 9:1.

Therefore, there is a need in the art for an age hardenable copper-beryllium alloy which produces enhanced levels of formability (lower R/T ratios), especially in the direction parallel to the rolling direction, together with conventional levels of strength, ductility, stress-relaxation and electrical conductivity.

SUMMARY OF THE INVENTION

The present process yields an age hardenable copper-beryllium alloy which has improved, substantially isotropic levels of formability, especially in the direction parallel to the alloy rolling direction together with satisfactory levels of strength, ductility, stress-relaxation and electrical conductivity by means of a novel thermomechanical treatment.

A treatment process is provided for a copper-beryllium alloy comprising from about 0.2% to about 0.7% beryllium, no greater than about 3.5% selected from the group consisting of cobalt and nickel and mixtures thereof, no greater than about 0.5% selected from the group consisting of titanium and zirconium and mixtures thereof, and at least about 90% copper, wherein the alloy has been cold worked to a ready-to-finish gauge.

The process comprises the steps of annealing the cold worked ready-to-finish gauge copper-beryllium alloy at a temperature from about 1500° F. to about 1685° F., cold working the annealed copper-beryllium alloy to reduce its gauge in a range from about 20% to about 60%; and age hardening the copper-beryllium alloy at a temperature of from about 700° F. to about 950° F. for about 1 to about 7 hours. Tension leveling may be included in the present method before the age hardening step. Tension leveling may also be included in the present method after the age hardening step.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENTS

The present treatment process is believed to be adaptable to the manufacture of copper-beryllium alloys within the range of alloying materials described herein. These alloys will generally comprise from about 0.2% to about 0.7% beryllium, up to about 3.5% of material selected from the group consisting of cobalt and nickel and mixtures thereof, up to about 0.5% of material selected from the group consisting of titanium and zirconium and mixtures thereof, and at least about 90% copper. Preferably the alloy comprises at least 1.0 wt % nickel The present process is particularly directed to preferred alloy compositions within the composition limits of a high-copper alloy, specifically designated alloy C17510 under the Unified Numbering System. C17510 is defined as comprising up to 0.01% Fe, 1.4% to 2.2% Ni, up to 0.30% Co, up to 0.20% Si, 0.2% to 0.6% Be, up to 0.2% Al, with the remainder comprising copper.

The copper-beryllium alloy is prepared in a melt form which is cast, conditioned, heat treated and cold worked to a ready-to-finish gauge according to any standard method known to those skilled in the art. The ready-to-finish gauge cold worked copper-beryllium alloy is then treated with the present process.

Figure 1:
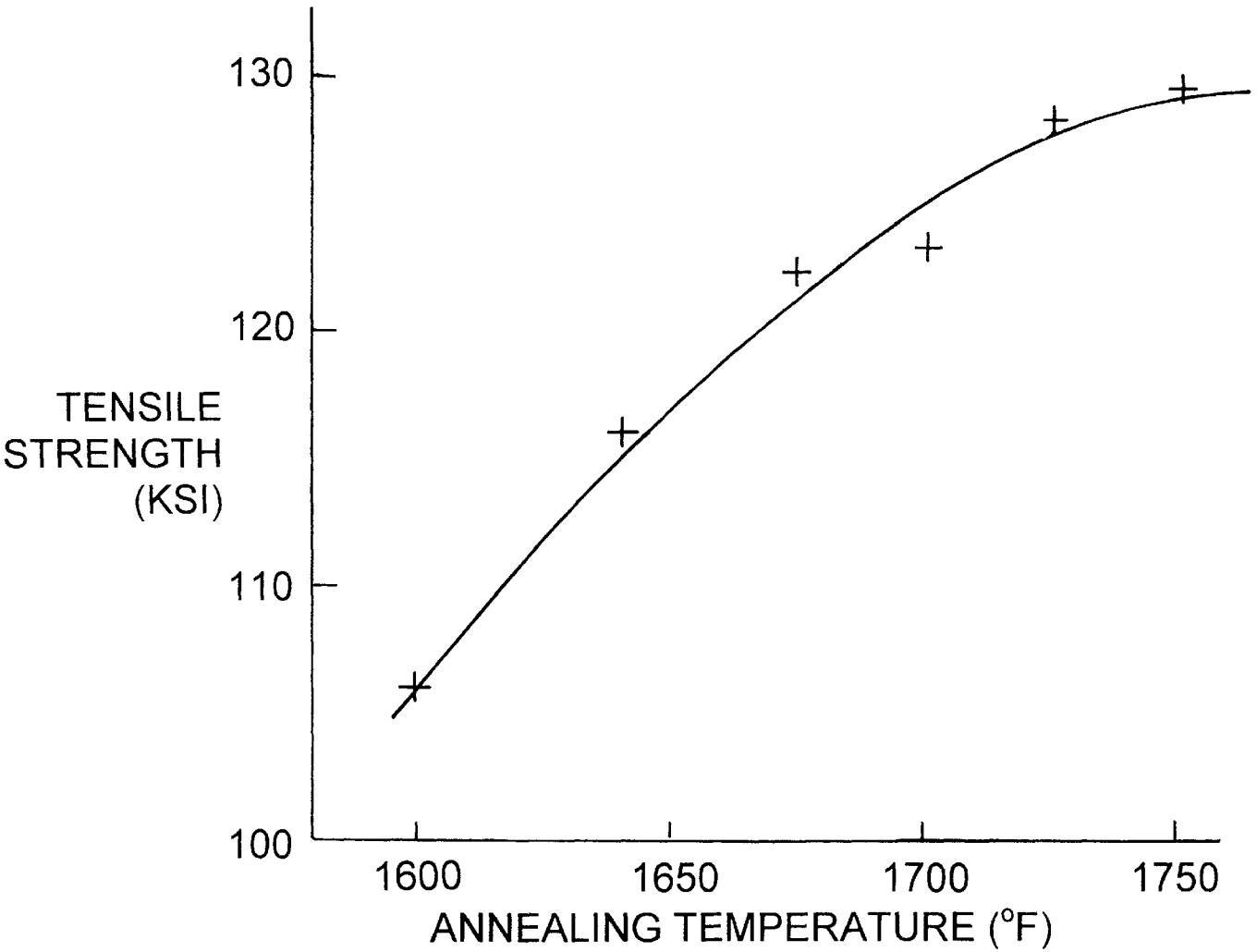
FIG. 1 is a plot of the tensile strength (after age hardening) against the annealing temperature for a nominal copper alloy in accordance with the present invention comprising 1.95% nickel and 0.4% beryllium.

Solution anneals for ready-to-finish gauge cold worked C17510 are conventionally performed at temperatures of 1750° F. or higher. Higher temperatures shorten the time period for annealing thereby reducing production costs and improving production rates. The higher temperatures used in previous methods dissolve more beryllium and nickel and/or cobalt in the copper matrix, producing more second phase precipitate upon age hardening. This greater amount of higher second phase precipitate provides higher strength as shown in FIG. 1. Lower temperature annealing is characterized by the presence of finer grains. By using lower temperature annealing from about 1500° F. to about 16850F, and preferably from about 1565° F. to about 1650° F., the present process has achieved unexpected, beneficial results as described below.

Figure 2:
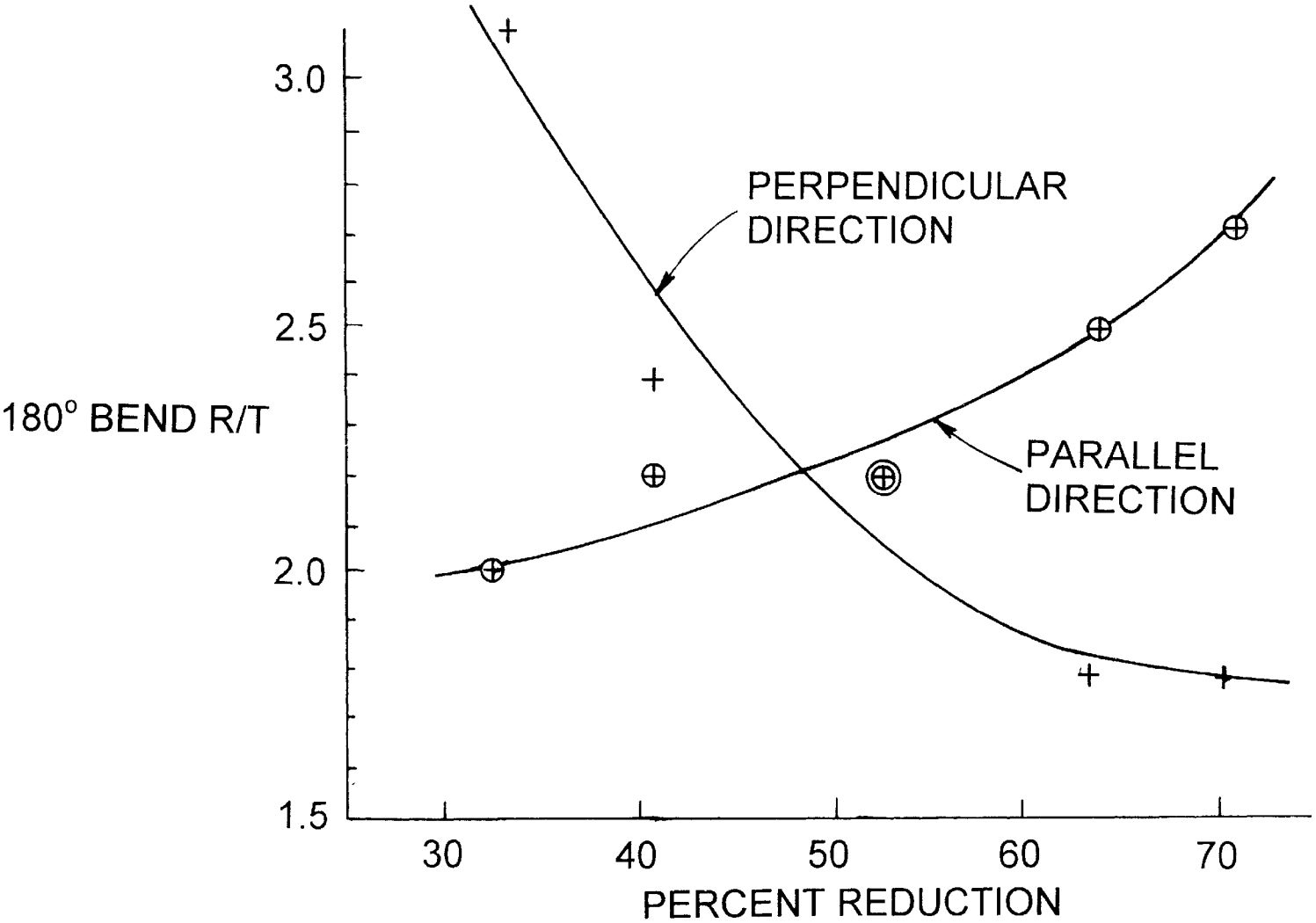
FIG. 2 is a plot of 180° bend R/T ratios (after age hardening) against reduction in cross-section.

The annealed copper-beryllium is cold worked to reduce its cross-section, typically its vertical thickness in the form of a strip, in the range of from about 20% and about 60%, and preferably from about 50% to about 60%, to develop specific improved, isotropic formability in the direction of both the parallel axis and the perpendicular axis of alloy rolling. FIG. 2 shows that more reduction favors perpendicular direction formability and less reduction favors parallel direction formability. The final product can be made to exhibit isotropic formability or superior parallel or perpendicular formability as desired for particular applications.

Figure 3:
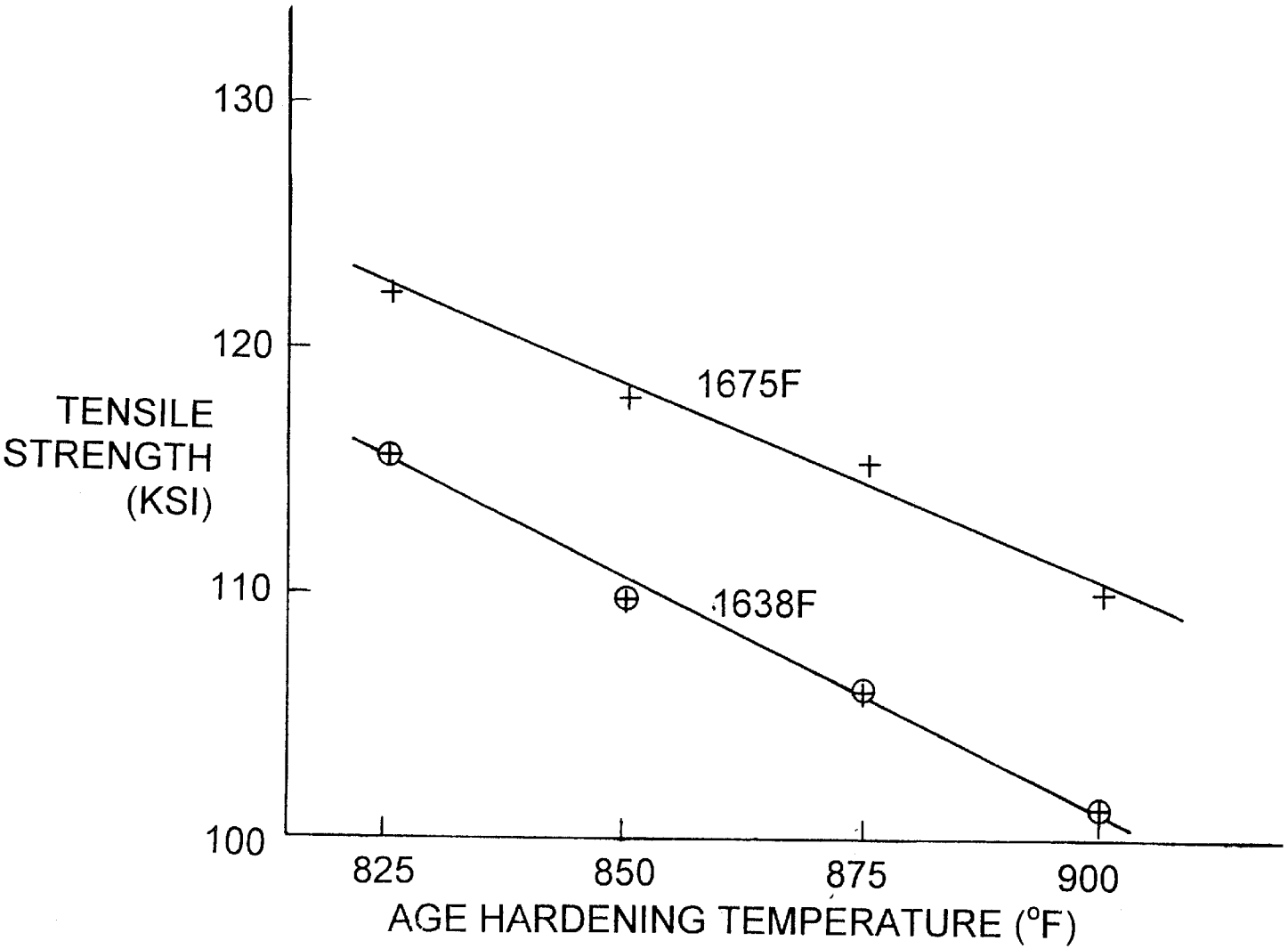
FIG. 3 is a plot of tensile strength against age hardening temperature for two annealing temperatures.

The cold worked material is age hardened at a temperature of from about 700° F. to about 950° F. to develop the desired mechanical properties. FIG. 3 shows that higher age hardening temperatures generally produce lower values for mechanical properties, specifically tensile strength—a condition that typically occurs when material is processed in accordance with this invention. The time period required at a given temperature varies from about one to about seven hours, and preferably from about three to about seven hours.

Figure 4:
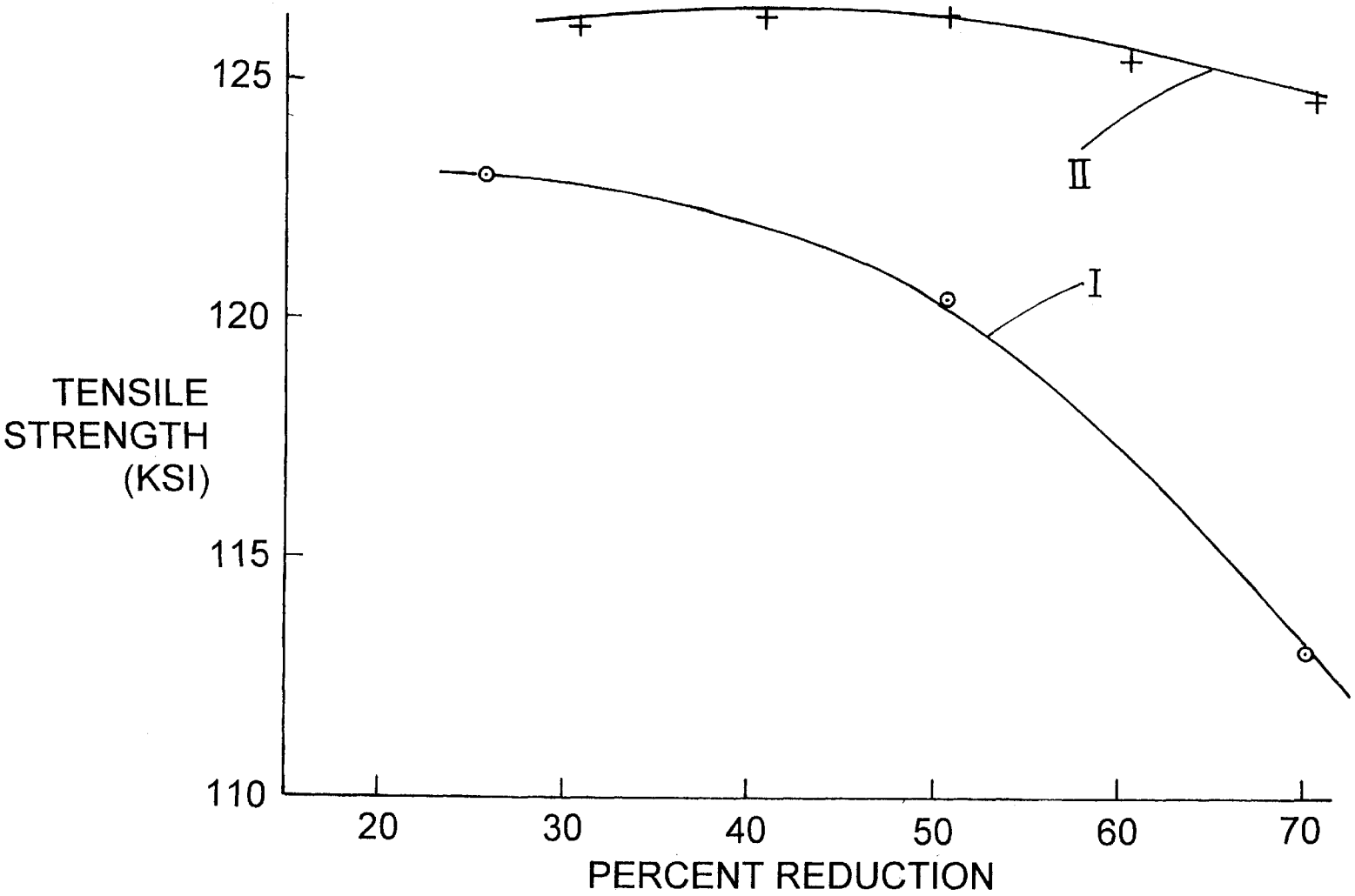
FIG. 4 is a plot of tensile strength (after age hardening) against reduction in cross-section for two process conditions.

FIG. 4 shows how tensile strength is affected by cold work prior to final age hardening. Curve I is typical of prior processes for the same alloy in which increased cold reduction results in lower strength values. This would be expected in over-aged material, because the more severely cold worked material would lose strength faster. An unexpected result is the nearly flat curve shown in Curve II representing examples of the same alloy treated in accordance with the present invention.

It has been discovered that in practicing the present process, certain combinations of annealing temperatures, percentage cold reduction and age hardening temperatures produce material in which tensile strength remains within a narrow range but formability varies as previously described with the degree of cold reduction over a wide range. Thus, the present process allows the manufacture of strip to commercially useful strength levels with varying bend formability characteristics required for particular high copper alloy applications.

The claimed alloys made from the present process are those which comprise from about 0.2% to about 0.7% beryllium, up to about 3.5% of material selected from the group consisting of cobalt and nickel and mixtures thereof, up to about 0.5% of material selected from the group consisting of titanium and zirconium and mixtures thereof, and at least about 90% copper, substantially within the range for alloys which meet the composition limits of the high-copper alloy C17510. The alloys made by the present process exhibit improved, isotropic formability in the directions both parallel and perpendicular to the direction of alloy rolling while maintaining conventional levels of strength and electrical conductivity.

The present treatment process may further comprise a tension leveling step to impart flatness to the alloy before or after the age hardening step. In addition, a further stress relief thermal treatment step may be provided after age-hardening and tension-leveling the copper-beryllium alloy at a temperature of from about 500° F. to about 900° F. for a period of up to 7 minutes.

The invention will now be described in more detail with respect to the following specific, non-limiting examples:

EXAMPLE I

Copper-beryllium was melted, cast and hot-worked to a thickness of approximately 0.35 inch. It was then conditioned and cold-worked to a ready-to-finish gauge of 0.015 inch. The cold-worked copper-beryllium was then strand annealed, cold worked and age hardened as indicated in Table I. Annealing was performed at two different temperatures, 1750° F. and 1685° F. and cold rolling was performed to five different target gauges to effect a variety of percentages of cold reduction. Age hardening temperatures were selected to develop a target range of mechanical properties.

TABLE I

| Sample | Annealing Temp. (° F.) | Aging Temp. (° F.) | Aging Time (hours) | Percentage Cold Reduction |
|---|---|---|---|---|
| 1 | 1750 | 890 | 5 | 32 |
| 2 | 1750 | 890 | 5 | 40 |
| 3 | 1750 | 890 | 5 | 52 |
| 4 | 1750 | 890 | 5 | 63 |
| 5 | 1750 | 890 | 5 | 70 |
| 6 | 1685 | 825 | 5 | 30 |
| 7 | 1685 | 825 | 5 | 40 |
| 8 | 1685 | 825 | 5 | 50 |
| 9 | 1685 | 825 | 5 | 60 |
| 10 | 1685 | 825 | 5 | 70 |

Strip samples of the same alloy were tested parallel to the rolling direction for ultimate tensile strength (UTS), 0.2% yield strength (YS), elongation, electrical conductivity, and 90° and 180° perpendicular (⊥) axis and parallel (‖) axis bend tests. The results of these tests are shown in Table II. The chemistry of the copper beryllium strip is listed in Table III, with copper being the balance of the listed alloying materials.

TABLE II

| Sample | UTS (ksi) | YS (ksi) | Elong-ation (%) | Conduc-tivity (% IACS) | 180° R/T ⊥ | 90° R/T ⊥ | 180° R/T ‖ | 90° R/T ‖ |
|---|---|---|---|---|---|---|---|---|
| 1 | 126.2 | 116.5 | 10 | 56.9 | 3.1 | 2.5 | 2.0 | 1.5 |
| 2 | 124.7 | 115.2 | 10 | 57.1 | 2.4 | 2.2 | 2.2 | 1.7 |
| 3 | 122.7 | 112.4 | 10.3 | 57.8 | 2.2 | 1.7 | 2.2 | 1.7 |
| 4 | 121.3 | 110.5 | 10.2 | 60.0 | 1.8 | 0.7 | 2.5 | 1.4 |
| 5 | 118.2 | 106.9 | 10 | 61.3 | 1.8 | 0.1 | 2.7 | — |
| 6 | 125.7 | 113.1 | 12.7 | 55.2 | 1.9 | 1.9 | 1.5 | 0.1 |
| 7 | 125.8 | 114.8 | 9.3 | 54.9 | 2.0 | 1.7 | 1.6 | 0.1 |
| 8 | 127.1 | 116.6 | 11.7 | 55.7 | 1.9 | 1.3 | 1.9 | 0.5 |
| 9 | 124.4 | 116.3 | 12 | 54.9 | 1.7 | 0.7 | 2.0 | 0.7 |
| 10 | 125.9 | 116.9 | 9 | 58.2 | 1.8 | 0.1 | 2.2 | — |

TABLE III

| Element | Alloy Weight Percent |
|---|---|
| Beryllium | 0.40 |
| Iron | 0.05 |
| Silicon | 0.02 |
| Aluminum | 0.01 |
| Cobalt | 0.07 |
| Tin | 0.01 |
| Lead | 0.005 |
| Zinc | 0.02 |
| Nickel | 1.95 |
| Chromium | 0.004 |
| Manganese | 0.004 |
| Magnesium | <0.01 |
| Silver | <0.01 |
| Zirconium | 0.026 |
| Titanium | <0.002 |

COMPARATIVE EXAMPLE II

Copper-beryllium was melted, cast, and hot-worked to approximately 0.35 inch. The hot-worked copper-beryllium was then conditioned and cold worked to a ready-to-finish gauge of 0.016 inch. The cold worked copper-beryllium was next strand annealed at a temperature of approximately 1750° F., cold worked to a gauge of approximately 0.014 inches and heat treated at 890° F. for five hours.

The chemistry of the copper-beryllium is shown in Table IV, with copper being the balance of the alloying materials.

TABLE IV

| Element | Alloy Weight Percent |
|---|---|
| Beryllium | 0.410 |
| Iron | 0.034 |
| Silicon | 0.024 |
| Aluminum | 0.011 |
| Cobalt | 0.120 |
| Nickel | 1.876 |

Samples of this alloy were tested from both ends of a coil for ultimate tensile strength, 0.2%. yield strength, elongation, electrical conductivity and 90° (⊥ and ‖) bend tests R/T. The average results of the tests are shown in

TABLE V

| UTS (ksi) | YS (ksi) | Elong-ation (%) | Conduc-tivity (% IACS) | 90° R/T ⊥ | 90° R/T ‖ |
|---|---|---|---|---|---|
| 122.6–123.2 | 105.1–108.0 | 16 | 58 | 1.4 | 0.3 |

EXAMPLE III

Copper-beryllium was melted, cast and hot-worked to approximately 0.6 inch. The hot-worked copper-beryllium was then conditioned and cold worked to approximately 0.1 inch. Subsequently, the copper-beryllium was annealed and cold worked to a ready-to-finish gauge; then strand annealed, cold worked and age hardened as indicated in Table VI. Finish gauge was 0.005 inch for 50% and 87% cold reduction samples, and 0.009 inch for 10% cold reduction samples.

TABLE VI

| Sample | Annealing Temp. (° F.) | Aging Temp. (° F.) | Aging Time (Hours) | Percentage Cold Reduction |
|---|---|---|---|---|
| 1 | 1565 | 775 | 5 | 10 |
| 2 | 1565 | 825 | 5 | 10 |
| 3 | 1565 | 775 | 5 | 50 |
| 4 | 1565 | 825 | 5 | 50 |
| 5 | 1565 | 775 | 5 | 87 |
| 6 | 1565 | 825 | 5 | 87 |
| 7 | 1590 | 775 | 5 | 10 |
| 8 | 1590 | 825 | 5 | 10 |
| 9 | 1590 | 775 | 5 | 50 |
| 10 | 1590 | 825 | 5 | 50 |
| 11 | 1590 | 775 | 5 | 87 |
| 12 | 1590 | 825 | 5 | 87 |
| 13 | 1650 | 775 | 5 | 10 |
| 14 | 1650 | 825 | 5 | 10 |
| 15 | 1650 | 775 | 5 | 50 |
| 16 | 1650 | 825 | 5 | 50 |
| 17 | 1650 | 775 | 5 | 87 |
| 18 | 1650 | 825 | 5 | 87 |
| 19 | 1685 | 775 | 5 | 10 |
| 20 | 1685 | 825 | 5 | 10 |
| 21 | 1685 | 775 | 5 | 50 |
| 22 | 1685 | 825 | 5 | 50 |
| 23 | 1685 | 775 | 5 | 87 |
| 24 | 1685 | 825 | 5 | 87 |

The chemistry of the copper-beryllium used for this example is shown in Table VII, with copper being the balance of the alloying materials.

TABLE VII

| Element | Alloy weight Percent |
|---|---|
| Beryllium | 0.42 |
| Iron | 0.01 |
| Silicon | 0.01 |
| Aluminum | 0.018 |
| Cobalt | 0.02 |
| Nickel | 1.94 |

These samples were tested for ultimate tensile strength, 0.2% yield strength, elongation, electrical conductivity, and 180° perpendicular and parallel axis bend tests. Bend test acceptance criteria included the absence of significant "orange peel" or surface pitting resembling the skin of an orange. This standard was adopted as it is a tougher standard to comply with as compared to the absence of cracking. The smallest test radius available was 0.005 inch. The samples which passed with this particular test radius are so indicated in the test results. The results of the tests appear in Table VIII.

TABLE VIII

| Sample | UTS* (ksi) | YS* (ksi) | Elongation (%) | Conductivity (% IACS) | 180° R/T ‖ | 180° R/T ⊥ |
|---|---|---|---|---|---|---|
| 1 | 81.2 | 68.4 | 18 | 56 | 0.6† | 0.7 |
| 2 | 85.2 | 74.0 | 17 | 59 | 0.6† | 0.6† |
| 3 | 102.3 | 92.1 | 10 | 60 | 1.0† | 1.0† |
| 4 | 99.1 | 91.3 | 8 | 64 | 1.0† | 1.0† |
| 5 | 96.7 | 90.8 | 8 | 64 | 1.0† | 1.0† |
| 6 | 81.6 | 74.3 | 10 | 70 | 1.0† | 1.0† |
| 7 | 87.4 | 71.7 | 20 | 55 | 0.6† | 0.6† |
| 8 | 84.1 | 70.8 | 19 | 57 | 0.6† | 0.6† |
| 9 | 103.9 | 94.8 | 9 | 59 | 1.0† | 1.0† |
| 10 | 102.5 | 93.4 | 10 | 62 | 1.0† | 1.0† |
| 11 | 101.1 | 94.7 | 10 | 61 | 1.6 | 1.0† |
| 12 | 83.8 | 76.0 | 10 | 69 | 1.0† | 1.0† |
| 13 | 109.9 | 91.8 | 18 | 59 | 1.1 | 0.7† |
| 14 | 103.4 | 87.5 | 17 | 61 | 1.1 | 0.7 |
| 15 | 116.1 | 105.7 | 13 | 58 | 1.0† | 1.0† |
| 16 | 108.3 | 101.0 | 8 | 62 | 1.0† | 1.0† |
| 17 | 107.3 | 100.9 | 12 | 61 | 2.4 | 1.0† |
| 18 | 95.3 | 88.2 | 13 | 67 | 1.6 | 1.0† |
| 19 | 117.9 | 98.2 | 15 | 57 | 0.6† | 1.1 |
| 20 | 107.6 | 90.1 | 15 | 61 | 0.6† | 0.7 |
| 21 | 124.6 | 111.7 | 10 | 58 | 1.0† | 1.2 |
| 22 | 112.1 | 103.7 | 6 | 62 | 1.0† | 1.0† |
| 23 | 112.2 | 105.4 | 9 | 61 | 2.4 | 1.2 |
| 24 | 94.1 | 87.5 | 8 | 68 | 1.2 | 1.2 |

*Average of four values
†Sample which passed with a radius of 0.005 inch.

The results in Example III indicate that the use of lower percentage cold reduction over a range of annealing and aging temperatures shows a relatively constant R/T bend in both the perpendicular and parallel axis directions. This shows improved and isotropic formability over a wide range of strength levels.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A treatment process for providing substantially uniform formability in both a perpendicular and a parallel rolling direction of a strip of a copper-beryllium alloy consisting essentially of from 0.38% to about 0.6% beryllium, from about 1.4% to about 2.2% nickel, from about 0% to about 2.1 cobalt, no greater than about 0.5% selected from the group consisting of titanium and zirconium and mixtures thereof, and at least about 90% copper, wherein the alloy has been cold worked to a ready-to-finish gauge, comprising the steps of:

(a) annealing the cold worked ready-to-finish gauge copper-beryllium alloy strip at a temperature from about 1500° F. to 1600° F.;

(b) further cold working the annealed copper-beryllium alloy strip to reduce its gauge by an amount in a range from about 20% to about 60%; and (c) age hardening the further cold-worked copper-beryllium alloy strip at a temperature of from about 700° F. to about 950° F. for about 1 to about 7 hours to produce substantially uniform formability in both the parallel and perpendicular rolling directions in the copper-beryllium alloy strip, wherein the 180° R/T bend ratio of the age-hardened copper-beryllium alloy strip in both the parallel and perpendicular rolling directions is no greater than about 1.4.

2. The process according to claim 1, wherein the alloy further comprises at least about 1.0% nickel.

3. The process according to claim 1, further comprising a step of tension leveling the alloy before the age hardening step (c).

4. The process according to claim 1, further comprising a step (d) of tension leveling the alloy after the age hardening step (c).

5. The process according to claim 1, wherein the cold worked ready-to-finish gauge copper-beryllium alloy is annealed at a temperature from about 1565° F. to about 1650° F.

6. The process according to claim 1, wherein the annealed copper-beryllium alloy is cold worked to reduce its gauge in a range from about 50% to about 60%.

7. The process according to claim 4, further comprising a step (e) of heat treating the age hardened copper-beryllium alloy at a temperature of from about 500° F. to about 900° F. for a period of up to 7 minutes.

8. The process according to claim 1, wherein the copper-beryllium alloy is age hardened from about 3 to about 7 hours.

9. A copper-beryllium alloy treated by the process according to claim 1.

* * * * *